United States Patent [19]

Pfulb

[11] 4,306,926

[45] Dec. 22, 1981

[54] BOTTLE LABELING MACHINE AND METHOD

[75] Inventor: Manfred Pfulb, Dusseldorf, Fed. Rep. of Germany

[73] Assignee: Jagenberg Werke AG, Dusseldorf, Fed. Rep. of Germany

[21] Appl. No.: 150,392

[22] Filed: May 16, 1980

[30] Foreign Application Priority Data

Jun. 6, 1979 [DE] Fed. Rep. of Germany ..... 2922899

[51] Int. Cl.[3] ..... B65C 3/18; B65C 3/22

[52] U.S. Cl. ..... 156/215; 156/475; 156/560; 156/567; 156/571; 156/DIG. 14; 156/DIG. 16

[58] Field of Search ..... 156/560, 567, 568, DIG. 26, 156/DIG. 27, 212, 215, 475, 485, 571, DIG. 14, 216

[56] References Cited

U.S. PATENT DOCUMENTS 3,707,417 12/1972 Dullinger ..... 156/560
3,861,986 1/1975 Wochner ..... 156/567
4,118,269 10/1978 Zodrow ..... 156/560
4,146,421 3/1979 Zodrow ..... 156/560
4,152,192 5/1979 Zodrow et al. ..... 156/560

FOREIGN PATENT DOCUMENTS 670362 4/1952 United Kingdom ..... 156/DIG. 27

*Primary Examiner*—Michael G. Wityshyn
*Attorney, Agent, or Firm*—Sprung, Felfe, Horn, Lynch & Kramer

[57] ABSTRACT

A bottle labeling method and machine has a bottle conveyor which transports bottles past two labeling stations and which rotationally controls the bottles to place them into different positions appropriate to the affixing and pressing on of labels. In the first labeling station in the direction of bottle travel, the simultaneous transfer of a bottle-neck foil and of a back label is effected and in the second labeling station the simultaneous transfer of one of at least one partial neck label and a neck ring label and of a belly label is effected.

3 Claims, 5 Drawing Figures

BOTTLE LABELING MACHINE AND METHOD

BACKGROUND OF THE INVENTION

The invention relates to a labeling method and machine for bottles comprising conveying means, and in particular an annular bottle carrier, which transports the bottles past a plurality of labeling stations and by means of rotational controls places them into different positions appropriate to the affixing and pressing on of the labels.

Bottles in deluxe makeup are wrapped with foil around their neck. However, this foil wrap is truly attractive only when the lower edges are aligned with each other where they overlap. Now this is a requirement which in practice is virtually impossible to satisfy for a variety of reasons, such as the conicity of the bottle neck, imprecise transfer of the foil to the bottle, and diameter variations from one bottle to the next. To conceal these unattractive poorly overlapping edges, the practice of applying a ring label which covers the lower edge of the foil has been resorted to.

Another way to conceal misalignment of the lower edges where they overlap is to use special precut foils with angled edges. However, such foils are more expensive to produce than simple cut-to-size foils.

In a prior-art labeling machine of the type outlined above, the various labels are affixed by means of three labeling stations, the first of these serving to transfer the foil, the second to transfer the back label, and the third to transfer the belly label and the neck label or neck ring label. With this labeling machine, the foil is affixed in such a way that the vertical lap seam is located in the back of the bottle.

SUMMARY OF THE INVENTION

The invention has as its object to provide a labeling machine permitting the appearance of the bottle to be improved at but slight expenditure.

In accordance with the invention, this object is accomplished in that the first labeling station in the direction of bottle travel is equipped for the simultaneous transfer of a bottle-neck foil and of a back label, and the second labeling station for the simultaneous transfer of a partial neck label or a ring neck label and of a belly label and, optionally, a further partial neck label.

In contrast to prior-art labeling machines for affixing a bottle-neck foil, a back label, a belly label, and a partial neck or neck ring label, the labeling machine in accordance with the invention requires but two labeling stations. The fact that the vertical lap seam of the bottle-neck foil then comes to be located on the front of the bottle is not a disadvantage in this case since the vertical lap seam, along with any misalignment of the lower edges where they overlap, will be covered by the neck ring label. In fact, that label need not even surround the bottle neck completely, which means that an improved appearance of the bottle can be secured at a saving in material.

Moreover, no special precut bottle-neck foil, which because of the angled edges would result in cutting waste, is needed. A further advantage of the labeling machine in accordance with the invention is that since there are only two labeling stations, there is less need to change the rotational position of the bottle and that a longer path is available for each pressing-on operation.

BRIEF DESCRIPTION OF THE DRAWINGS

The invention will now be described in greater detail with reference to the accompanying drawing illustrating an embodiment, wherein.

DETAILED DESCRIPTION OF THE INVENTION

Figure 1:
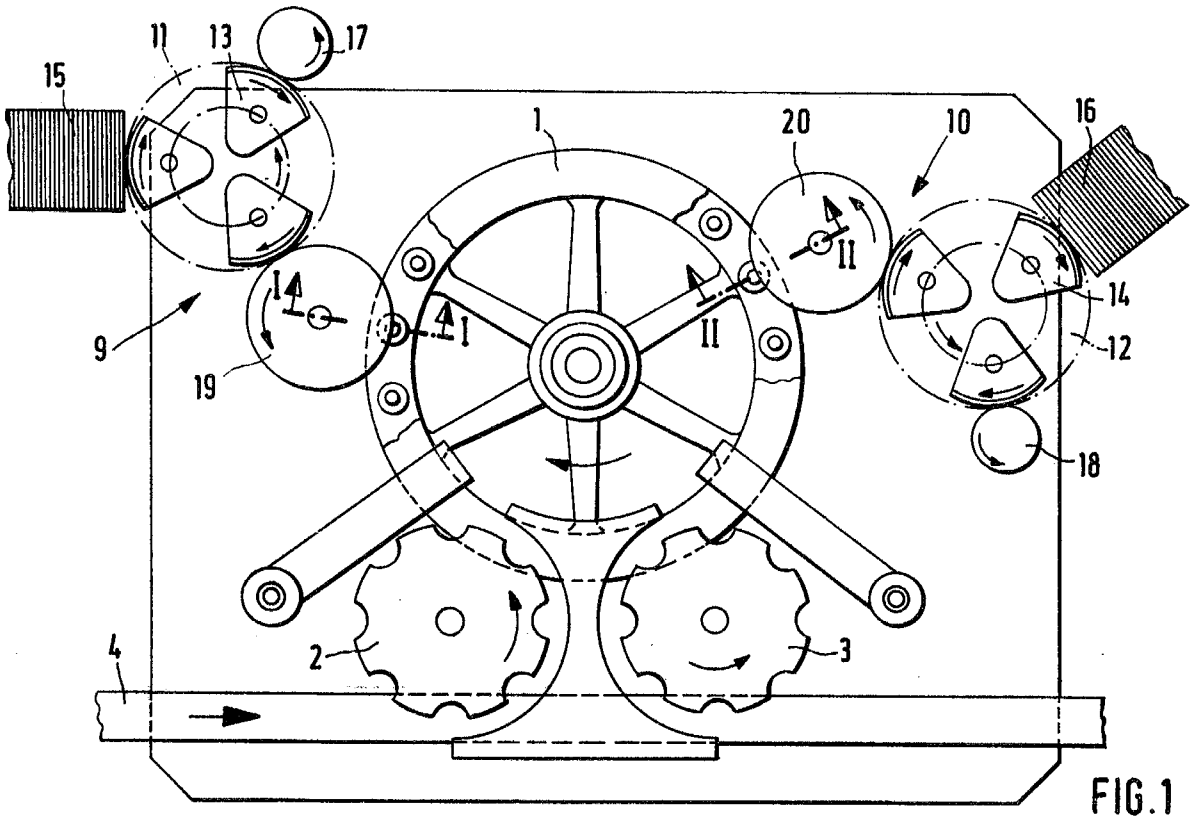
FIG. 1 is a diagrammatic top plan view of a labeling machine according to the invention.
Figure 2:
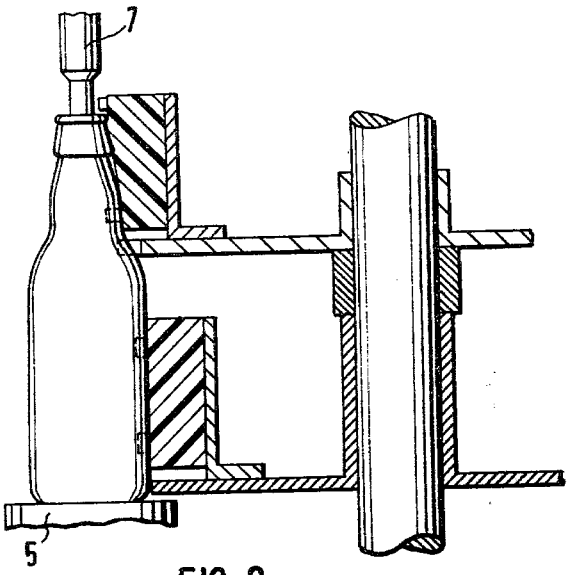
FIG. 2 shows a bottle and a portion of the gripper cylinder of the first labeling station in a sectional view taken along the line I—I in FIG. 1.
Figure 4:
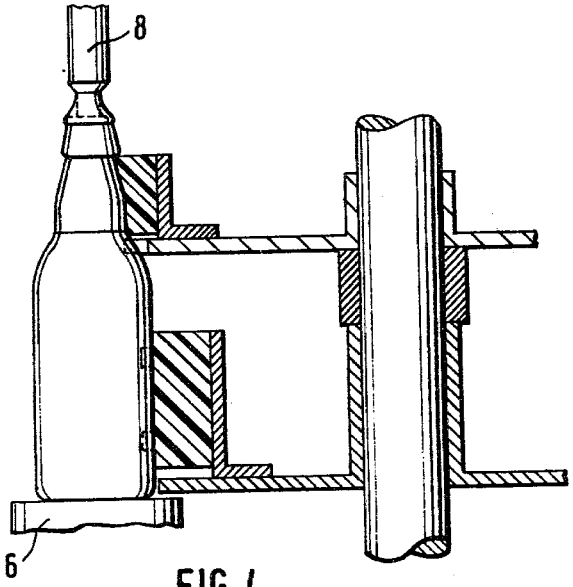
FIG. 4 shows a bottle and the gripper cylinder of the second labeling station in a sectional view taken along the line II—II in FIG. 1.

Referring now to FIG. 1, the essential components of the labeling machine are a bottle carrier 1 rotating in the direction indicated by the arrow, an infeed star wheel 2 and an outfeed star wheel 3. The infeed star wheel 2 transfers the bottles, delivered by a conveyor belt 4 and spaced by means of a worm (not shown), to the carrier 1 while the outfeed star wheel 3 transfers the bottles to the conveyor belt 4, which travels on. The bottle carrier 1 comprises a plurality of holding positions, each of which consists of a turntable 5,6 and a centering member 7,8 (FIGS. 2 and 4). The turntable 5,6 is cam-controlled in such a way that in the course of the travel of the bottles from the infeed star wheel 2 to the outfeed star wheel 3, the turntable positions the individual bottles properly for the transfer and pressing on of the labels.

The labeling machine comprises two identical labeling stations 9, 10 which differ from each other only with respect to the disposition of the pickup elements and of the gripper and pressure elements. Each labeling station 9, 10 consists of a rotating carrier 11, 12 comprising three sets of pickup elements 13, 14 which execute a controlled rotating or pivoting movement. Associated with the pickup elements 13, 14 are a label box 15, 16, a glue roll 17, 18 and a gripper cylinder 19, 20. Each set of pickup elements 13 of the first labeling station 9 consists of a pickup element for the bottle-neck foil and a pickup element for the back label while each set of pickup elements 14 of the second labeling station 10 consists of a pickup element for the partial neck label or neck ring label, of a pickup element for the belly label, and, optionally, of a further pickup element for a partial neck label to be affixed below the bottle-neck foil. Associated with the pickup elements 13, 14 are corresponding label stacks in the label boxes 15, 16. Also associated with the pickup elements are corresponding gripper and pressure elements in the gripper cylinders 19, 20, as shown in FIGS. 2 and 4.

Figure 3:
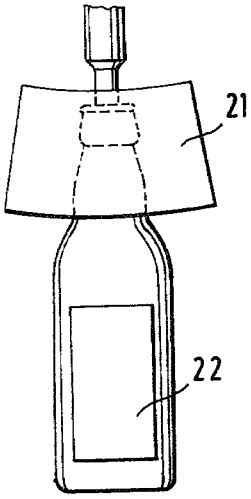
FIG. 3 is a front view of a bottle having a neck foil and a back label affixed to it.
Figure 5:
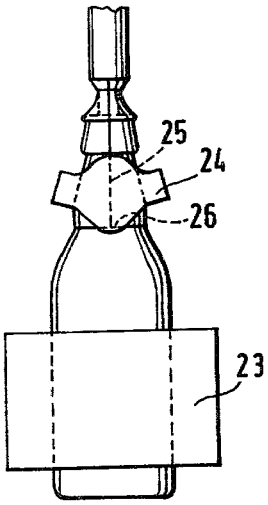
FIG. 5 is a front view of a bottle having a partial neck label and a belly label affixed to it.

The principle of operation of the labeling machine in accordance with the invention is as follows:

As shown in FIGS. 2 and 3, the bottles, held centered by the bottle carrier 1, are provided within the reach of the gripper cylinder 19 with a bottle-neck foil 21 and a back label 22. As it moves on, the bottle is turned in such a way that both the back label 22 and the bottle-neck foil are completely applied to it by brushes which are not shown. As shown in FIGS. 4 and 5, by the time it reaches the vicinity of the gripper cylinder 20, the bottle has executed a 180° turn relative to its position at the gripper cylinder 19. The gripper cylinder 20 applies the belly label 23 and the partial neck label 24 to the bottle. As is apparent from FIG. 5, the partial neck label covers the vertical lap seam 25 of the foil, including the lower edge 26, over the entire neck area. Said vertical lap seam and lower edge therefore cannot detract from the appearance of the bottle. As the bottle travels on, the belly label 23 and the partial neck label 24 are then fully applied.

It will be appreciated that the instant specification and claims are set forth by way of illustration and not limitation, and that various changes and modifications may be made without departing from the spirit and scope of the present invention.

What is claimed is:

1. In a method of labeling a bottle in which bottles are transported past a plurality of labeling stations and in which the bottles are rotationally controlled to place them into different positions appropriate to the affixing and pressing on of labels, the improvement wherein two labeling stations are provided, a bottle-neck foil and a back label are simultaneously transferred in the first labeling station in the direction of bottle travel to the back of the bottle with the bottle-neck foil forming a seam at the front of the bottle and a partial neck label and a belly label are simultaneously transferred at the second labeling station to the front of the bottle with the neck label over the seam.

2. In a bottle labeling machine having conveying means which transports bottles past a plurality of labeling stations and which rotationally controls the bottles to place them into different positions appropriate to the affixing and pressing on of labels, the improvement wherein two labeling stations are provided, the first labeling station in the direction of bottle travel comprising means for the simultaneous transfer of a bottle-neck foil and of a back label to the back of the bottle with the bottle-neck foil forming a seam at the front of the bottle and the second labeling station having means for the simultaneous transfer of a partial neck label and a belly label to the front of the bottle with the neck label over the seam.

3. The machine according to claim 2, wherein the conveying means comprises an annular bottle carrier.

* * * * *